United States Patent [19]

Ekroth

[11] Patent Number: 4,907,386

[45] Date of Patent: Mar. 13, 1990

[54] SHIELD FOR BUILDING FOUNDATION

[76] Inventor: Paul Ekroth, 12 Duncannon Ave., Worcester, Mass. 01604

[21] Appl. No.: 216,669

[22] Filed: Jul. 8, 1988

[51] Int. Cl.[4] ..... E04B 1/92; E02D 19/16

[52] U.S. Cl. ..... 52/169.14; 52/264; 52/300

[58] Field of Search ..... 52/169.6, 169.14, 264, 52/300, 408, 515, 516, 517

[56] References Cited

U.S. PATENT DOCUMENTS

| | | | |
|---|---|---|---|
| 2,899,771 | 8/1959 | Burris, Jr. | 52/169.14 |
| 3,429,085 | 2/1969 | Stillman, Jr. | 52/169.14 |
| 3,775,226 | 11/1973 | Windorf | 428/216 |
| 3,776,805 | 12/1973 | Hansen | 428/35 |
| 3,835,481 | 9/1974 | Engelhart et al. | 52/300 |
| 3,930,346 | 1/1976 | Blakeway | 52/169.6 |
| 4,359,845 | 11/1982 | Harrison | 52/169.6 |
| 4,620,398 | 1/1986 | Wallin | 52/169.1 |
| 4,625,468 | 12/1986 | Hampel | 52/2 |
| 4,633,629 | 1/1987 | Britz | 52/169.14 |

FOREIGN PATENT DOCUMENTS

| | | | |
|---|---|---|---|
| 78721 | 6/1980 | Japan | 52/169.14 |

OTHER PUBLICATIONS

Structural Failure in Residential Buildings (pp. 15–19) Wiley & Sons (Schild; Oswald; Rogier & Schweikert) vol. 3.

Radon Reduction Methods OPA86–005, Aug. 1986.

Radon Reduction Techniques for Detached Houses, EPA 625/5–86/019, Jun. 1986.

Citizen's Guide to Radon OPA86–004, Aug. 1986.

Radon and its Decay Products, ACS Symposium Series 331, Apr. 1986.

Foundation Engineering, John Wiley and Sons, 1953, pp. 171–173.

Controlling Indoor Air Pollution, Scientific American, May 1988, pp. 42–48.

*Primary Examiner*—Michael Safavi

*Attorney, Agent, or Firm*—Norman S. Blodgett; Gerry A. Blodgett

[57] ABSTRACT

Foundation shield impervious to radon, consisting of a first layer of polymer sheet, a second layer of metal foil, and a third layer of polymer sheet, the three layers being laminated together with the second layer sandwiched between the first and second layers.

2 Claims, 4 Drawing Sheets

SHIELD FOR BUILDING FOUNDATION

BACKGROUND OF THE INVENTION

It is a fairly recent phenomenon that public health officials have become alarmed at the affect of Radon on the health of the public and, particularly, on its having a role in causing lung cancer. Radon is a radioactive gas that originates naturally in the earth and is a decay product of the radioactive isotopes of polonium, lead, and bismuth. When this gas emerges into the open air, its concentration is reduced to a great extent and there is little danger of ill effects of it. Starting in about the year 1970, however, home owners became very concerned with airflow and heat transfer through the walls of their homes. Both factors cause a loss of heat and, therefore, procedures were taken to insulate the walls of homes and to seal any possible crack that would allow the loss of heated air. This has caused a reduction (at least throughout the United States) in the rate of air exchange between the inside and the outside residences, so that, when radon enters the living space, it stays there for a longer period of time. In the United States the amount of radon which investigators have found in homes varies to a great extent by at least four orders of magnitude. In terms of the normal measurement of radiation called "becquerels" per cubic meter of air, the enclosure concentration can vary from a few "becquerels" per cubic meter of air, to more than 10 thousand; the average level is about 50 "becquerels". This average indoor level represents a radiation dose of about 3 times larger than the dose a person obtains from X-rays and other medical procedures in the course of his lifetime. It has been stated that hundreds of thousands of Americans living in high radon houses receive more radiation than people living in the vicinity of the Chernobyl Nuclear Power Plant, when one of its reactors exploded. In any case, the concern with the radon problem has caused many investigators to work on ways of limiting the amount of radon in residences.

One method, for instance, of reducing radon is to form a large cavity under the foundation slab of the house and to have a small fan pumping the resulting gas into the open air. This reduces the pressure of radon on the foundation and, therefore, limits the flow of the gas from below the cellar floor into the living area. Another method, of course, is to increase the ventilation in the house by a fan which removes air from the house and introduces cleaner outside air; that is to say, one can change the air in the house more frequently. This has the disadvantage of increasing ones fuel cost. The fan pumping radon from under the foundation involves a piece of mechanical equipment which can become out-of-order and which must be maintained. Furthermore, any cavity under the building presents structural problems, as well as eventually becoming filled with dirt or water. The method of reducing radon that is highly recommended is to fill any cracks or holes in the foundation with a sealing compound. The difficulty with this procedure is that concrete and other foundation materials are not impervious to gas, so that the radon is able to permeate and pass through the foundation, even when all the cracks and the holes have been sealed. These and other difficulties experienced with the prior art methods have been obviated in a novel manner by the present invention.

It is, therefore, an outstanding object of the invention to provide a system for shielding a building foundation against the passage of radon, which system can be used when the foundation is first made or can be applied to a building whose foundation has existed for sometime.

Another object of this invention is the provision of a shield for a building foundation, which shield can be applied as the foundation is being formed.

A further object of the present invention is the provision of a shield for excluding radon from a building having a pre-existing foundation.

It is another object of the instant invention to provide a shield for a building foundation, which shield is simple in construction, which can be readily applied making use of inexpensive materials, and which is capable of a long life of useful service with a minimum of maintenance.

A still further object of the invention is the provision of a shield for radon which will maintain its integrity for a long period of time without attention.

It is a further object of the invention to provide a foundation shield which not only will exclude gases such as radioactive radon, but also will exclude moisture and other chemicals.

SUMMARY OF THE INVENTION

In general, the invention consists of a shield for a building foundation for excluding radon, wherein the foundation consists of a concrete slab on which are mounted vertical walls; three laminated layers in the form of a sheet are provided to lie along the slab and extend up the walls. The walls are formed with flat upper surfaces along which the sheet extends and a sill beam lies over the upper surfaces and clamp the sheets in place.

More specifically, the sheet consists of a first layer of polymer sheet, a second layer of metal foil, and a third layer of polymer sheet. The three layers are laminated together with the second layer sandwiched between the first and second layers.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
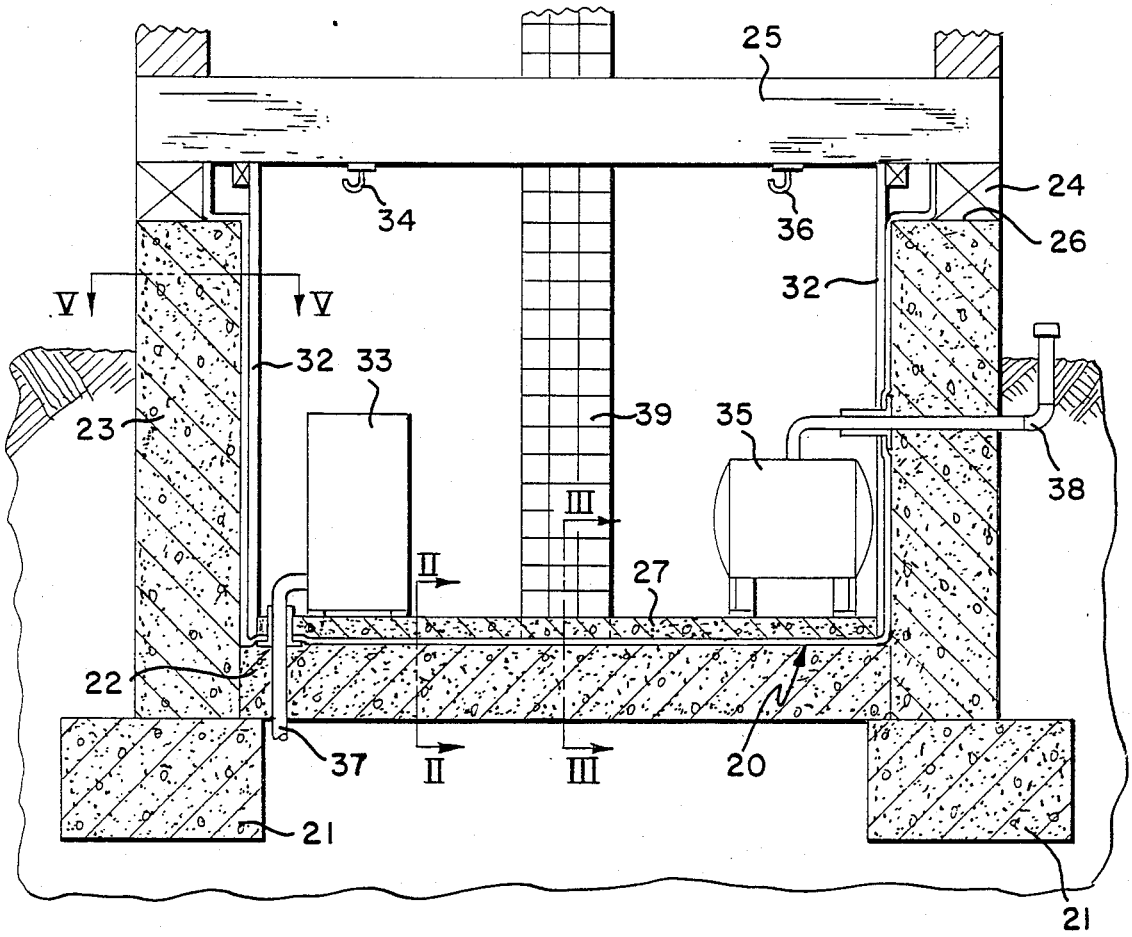
FIG. 1 is a vertical sectional view of a building foundation showing shield in place.

Referring first to FIG. 1, which best shows the general features of the invention, it can be seen that the shield, indicated generally by the reference numeral 20, is in use with a building foundation having a footing 21, a floor slab 22, a vertical wall 23, and a sill beam 24 resting on an upper horizontal surface 26 of the wall. The joists 25 of the building are shown as resting on the sill beam 24. A locking slab 27 rests on top of the shield 20 and the floor slab 22.

FIG. 1 shows the application of the shield 20 to a residential building which has been in existence for some time, but which shows signs of radon leakage into the living quarters from beneath the foundation.

Figure 2:
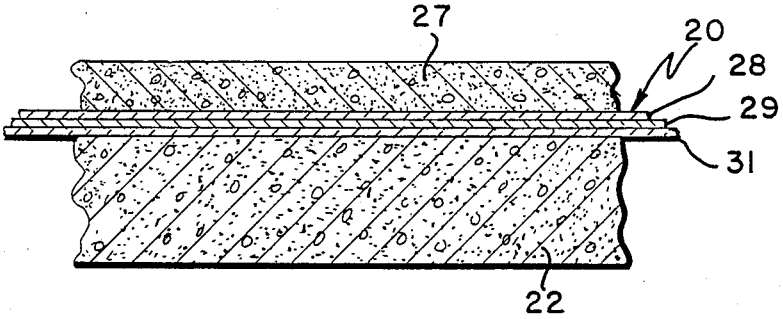
FIG. 2 is a sectional view of the foundation taken on the line II—II, of FIG. 1.

FIG. 2 shows a sectional view of the shield 20 lying on top of the floor slab 22 and carrying the locking slab 27. The shield 20 consist of a first layer 28 formed as a polymer sheet, a second layer 29 of metal foil, and a third layer 31 of polymer sheet. The three layers are laminated together with the second layer 29 sandwiched between the first layer 28 and the third layer 31. The first layer 28 is formed of heavy duty polyethylene and the second, and third layers 29 and 31 are in the form of aluminized Mylar, a polyester terephthalate manufactured by Dupont.

Returning again to FIG. 1, it can be seen that the building foundation consists of a footing 21 on which are mounted vertical walls 23 with a floor slab 22 lying on the footing between the walls. The three laminated layers 28, 29 and 31, forming the shield 20, lie along the upper surface of the slab 22 and extend up the walls 23. The footings 21 are only used in the case of a heavy building and normally would not be present in a residential building. The walls are formed with the flat upper surface 26 along which the shield 20 extends. The sill beam 24 lies over the upper surfaces of the wall and serve to hold the shield in place. In FIG. 1, the shield lies along the upper surface of the slab 22 and along the inner surfaces of the wall 23.

It is evident in FIG. 1 that a rigid protective layer 32 overlies the shield 20 along the vertical surfaces of the walls 23. The protective layer is held in place along the bottom edge by the locking slab 27 and is also fastened along its upper edge to the structure of the building, for instance, to the joists 25.

FIG. 1 shows the manner in which some of the elements of the residence lie within the foundation; for instance, a furnace 33 rests on the top of the locking slab 27 and has a hook 34 fastened to the joist above it, which hook was used in lifting the furnace during the application of the shield. Similarly, an oil tank 34 rests on the upper surface of the locking slab 27 and has a hook 36 overhead on the joist 25 by which the oil tank is lifted during the application of the shield 20. A water pipe 37 extends into the foundation through the floor and an oil filling pipe 38 also passes through one of the walls. A chimney 39 rests on the upper surface of the floor slab 22 and remains so during the application of the shield 20, as will be described more fully hereinafter.

Figure 3:
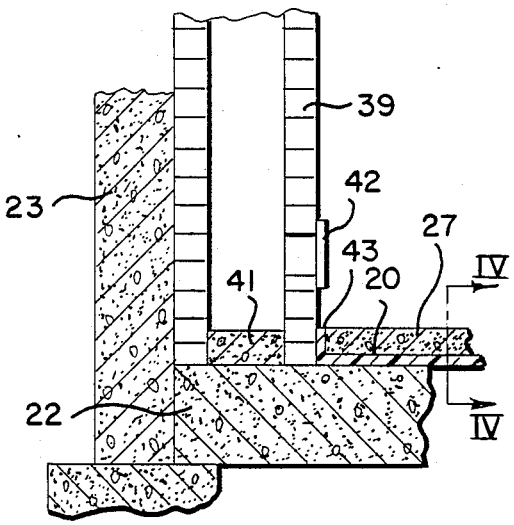
FIG. 3 is a vertical sectional view of the foundation taken on the line III—III, of FIG. 1.

FIG. 3 shows the manner in which the shield 20 is treated in connection with the chimney 39. The bottom of the chimney is sealed by a suitable sealant 41, poured into the base of the chimney through the access door 42. The shield 20 is formed with a flange around the base of the concrete, which flange 43 is locked in place by the locking slab 27.

Figure 4:
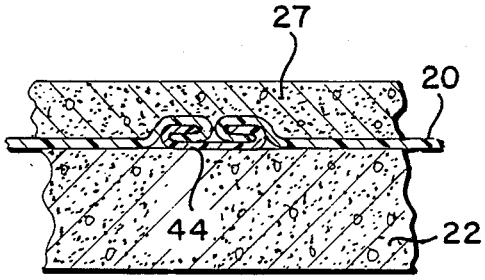
FIG. 4 is a vertical sectional view of the foundation taken on the line IV—IV, of FIG. 3.

FIG. 4 shows the manner in which a seam is formed between the various sheets making up the shield 20. The edges are folded back and locked together by a seam 44, after which the junction is fixed in place by the locking slab 27 which is poured over it.

Figure 5:
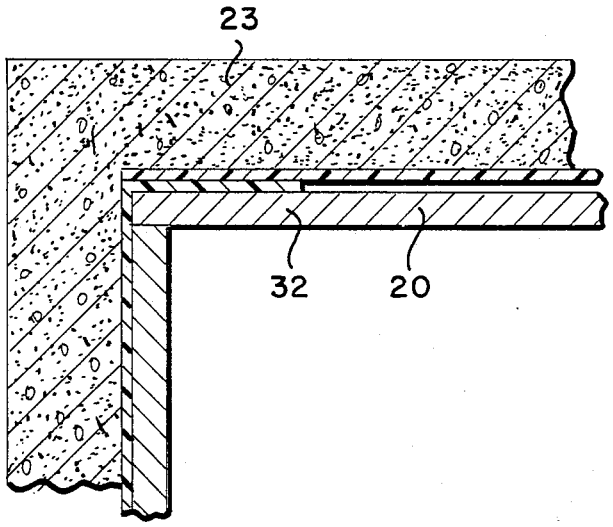
FIG. 5 is a horizontal sectional view of the foundation taken ,on the line V—V, of FIG. 1, FIGS. 6, 7 and 8 represent first, second and third steps of the application of a shield to a building foundation having hollow cement block walls.

FIG. 5 shows the manner in which the shield 20 is applied at the corner of the foundation. The single sheet which appears at the corner is cut and folded one layer upon the other as shown in the drawings, and locked in place by the protective layers 32 to hold the shield in place and to prevent injury to it by contact from within the residence.

Figure 6:
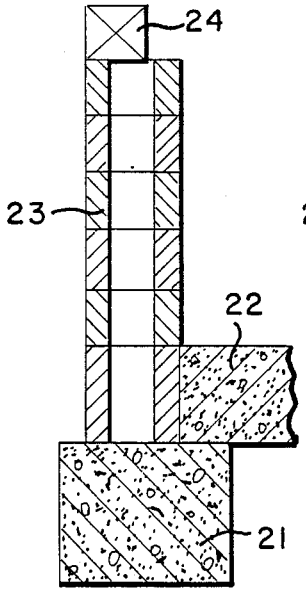
Figure 7:
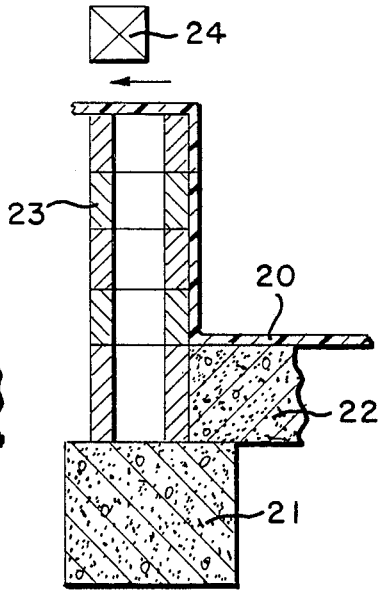
Figure 8:
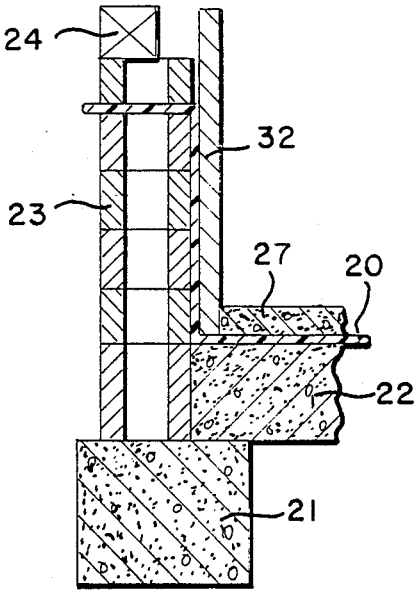

FIGS. 6, 7 and 8 show an alternate method of applying the shield 20, when the wall 23 is formed of hollow cinder blocks. It is, of course, necessary to prevent the passage of radon into the house through these blocks, and for that purpose the shield is passed over the top of the wall. In FIG. 6, the sill 24 is shown as resting on the top of the cinder block wall 23, and it is possible for radon to leak into the house by this path. In FIG. 7, a top block of the wall is removed, leaving a gap between the sill beam 24 and what is then the uppermost block. The shield passes over the top of the floor slab 22, up the inside surface of the wall 23, and then over the top end. In FIG. 8, the removed block is replaced, thus, restoring the wall to its original condition with an intervening layer of the shield 20. The protective layer 32 is used to hold the shield in place; the locking slab 27 is poured to hold the bottom of the protective layer and to furnish protection for the shield along the floor.

Figure 9:
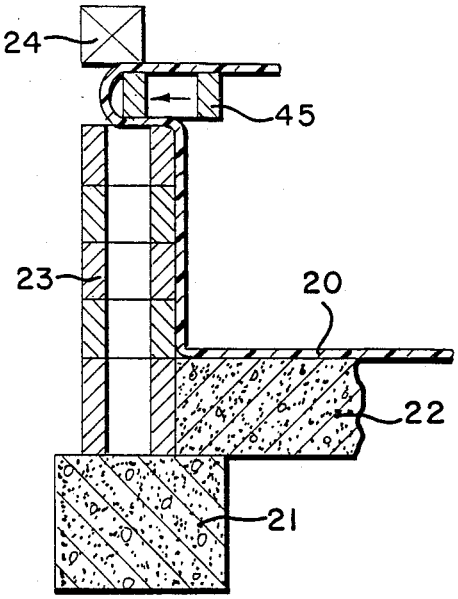
FIGS. 9 and 10 show a first and a second step of another method of applying a shield to a foundation having a concrete block wall.
Figure 10:
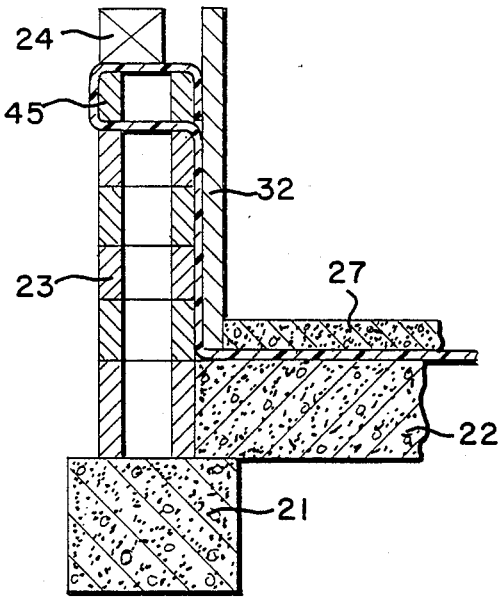

FIGS. 9 and 10 show an alternative method of applying the shield 20 to a wall 23 formed of concrete blocks. A top block 45 is removed and is then replaced after the shield 20 is looped into the opening between the sill beam 24 and the remainder of the blocks in the wall 23. A block is then inserted into the loop, as shown, and is locked in place along with a flap of the shield by the protective layer 32, which layer is then held in place by pouring the locking slab 27.

Figure 11:
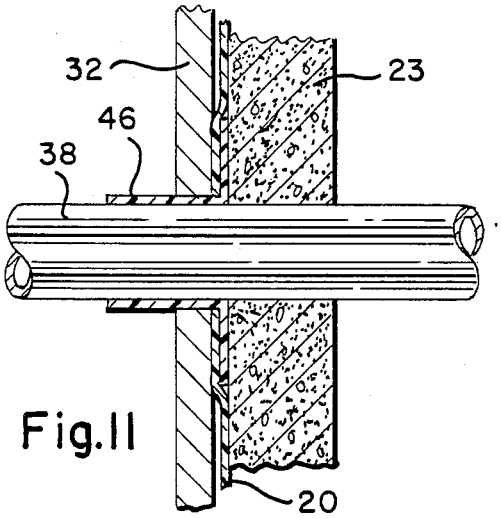
FIG. 11 is a vertical sectional of the foundation showing the details of application of the shield to a pipe passing through a foundation wall.

FIG. 11 shows the manner in which the pipe 38 entering the foundation through the wall 23 is sealed against the entry of radon. The pipe 38 is provided with a sleeve 46 that is formed of the three layer lamination that exist in the rest of the shield. This sleeve 46 has a radial flange which extends outwardly along the inside surface of the wall 23. The main shield 20 is provided with an aperture that fits tightly around sleeve 46 and the pipe 38; the protective layer 32 serves to lock the entire assemblage together. Suitable adhesives are used to hold the sleeve 46 on the pipe 38, as well as, to hold the shield 20 and the flange on the sleeve 46 together in tight conformation, as shown in the drawing.

Figure 12:
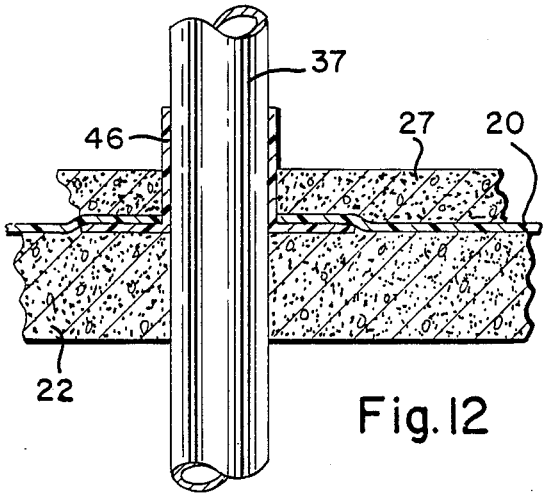
FIG. 12 is a vertical sectional view of a portion of the foundation the shield applied where a pipe passes through the floor of the foundation.

FIG. 12 shows the manner in which the entry of the water pipe 37 is sealed against the passage of radon. The same sleeve 46 is applied to the pipe by adhesive and has its flange extending outwardly along the upper surface of the floor slab 22. The shield 20, at this point, is provided with an aperture that fits tightly over the sleeve 46 and pipe 37 and impinges upon the flange of the sleeve 46. The entire assemblage is held together by a suitable adhesive. The locking slab 27 is then applied to hold the entire assemblage in place and to protect it against damage.

Figure 13:
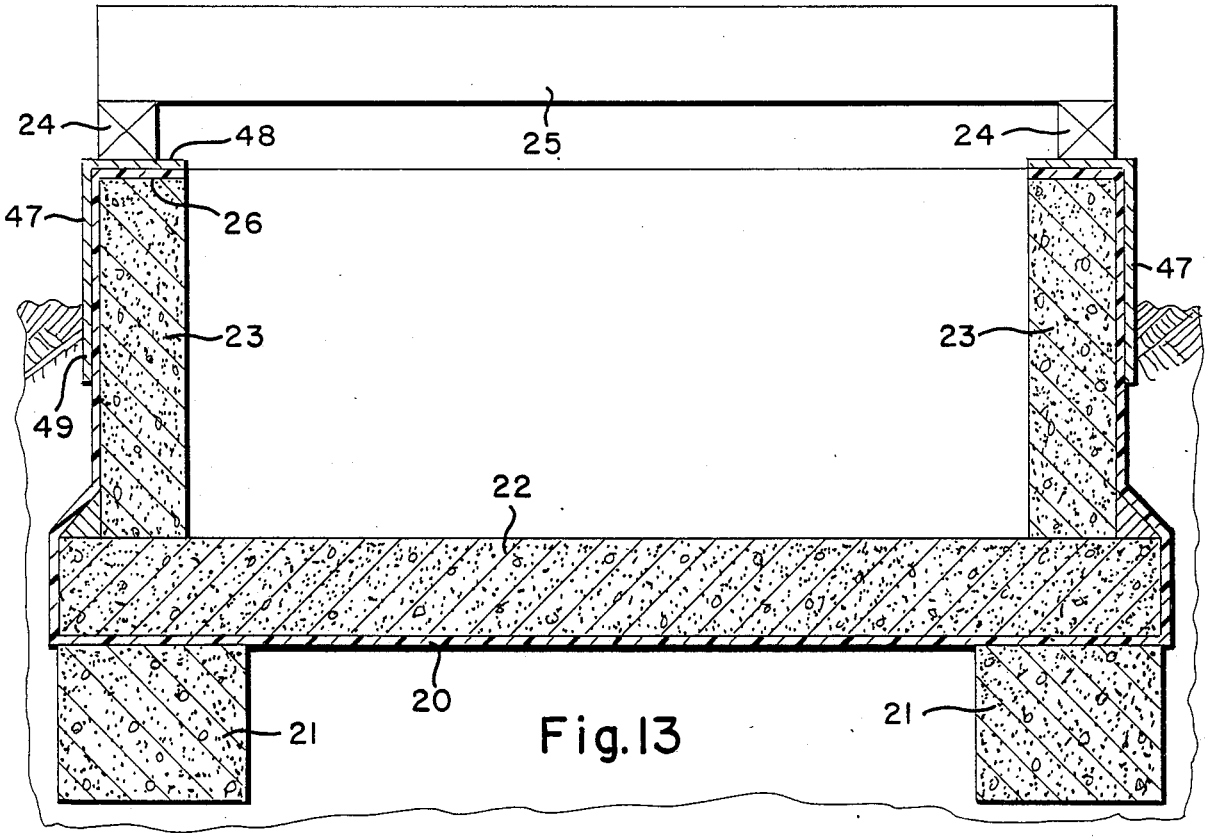
FIG. 13 is a vertical sectional view of a building showing a seal applied during the original construction of the foundation.

FIG. 13 shows the manner of application of the shield 20 to the exterior of the building at the time that the foundation is installed. In general, the footings 21 are first poured and the shield 20 is laid on top of it with large amounts extending outwardly of the sides in the excavation. The footings 21 would be used only in the case of a heavy building and would not normally be present in a residential building. The floor slab 22 is then poured in place and extends outwardly by several inches from the proposed periphery of the walls that are to be installed. The walls 23 are then poured in place by use of forms and the like. The shield is then moved up along the outside surface of the walls 23, and inwardly over the top surface 26. An L-shaped reinforcing element 47, formed of rigid heavy duty polyethylene, is laid over the portion of the shield 20 that lies along the top surface 26 of the wall. The horizontal leg 48 of the element 47 receives the sill beam 24, while the vertical leg 49 extends downwardly along the exterior of the foundation to a point that is well below the level to which the earth will be replaced.

Any pipe (not shown) that enters the foundation will be sealed by a sleeve in the manner shown in FIGS. 11 and 12, as will be readily understood.

The detail of the manner in which the shield 20 is applied during an original foundation installation is described more fully hereinafter:

A. After the excavation work has been done, mark the exact foundation size. Then, place any pipes that are to be under the finished floor. Now measure 4' beyond the foundation size on all sides and mark again.

B. Prepare the earth using a rake; any object not passing through the teeth together with all sharp objects should be removed. Ledge should be removed to level lower than the site and covered with sand or fine fill. Place sleeves 46 on any protruding pipes. Press down all small objects by compressing entire area using a roller or tamper.

C. Apply the shield 20 to cover the entire basement area plus, at least, 4' beyond the foundation size on all sides. Cut the shield above floor pipes to have a snug fit.

D. The entire basement is to have one floor slab 22; this is also the finished basement floor. To avoid cracks, maintain the same thickness throughout. Preparing to set the slab forms, use the outside forms only. Place the forms end to end, nailing them together to form one large slab. Forms are set 4" beyond the actual foundation size; the 4" edge thus formed is a convenience to support forms during the pouring of the walls. No forms and no bracing are to be used on the inside; the inside is to be left open for concrete only. After the forms are set and nailed together, it is time for bracing. No holes or stakes are to be driven through the construction shield 20. Forms are to braced from the outside only. Using 2×4's, the forms can be easily braced using the bank as a stop. If stakes are desirable, keep them at a safe distance from the shield. If reinforcement is to be used, now is the time.

E. It is desirable to pour the floor slab 22 directly from the truck or using a concrete pump. Skill is a must (while pouring) to maintain rods in proper placement, lest the construction shield 20 be punctured. If a wheel barrel is used, stay on planks. At all times protect the shield. This slab is not only a footing, but also the finished basement floor. It is important to have the finishers present and ready. The foundation, the lolly columns, the chimney, fireplaces and the bulkhead all come to rest on one solid finished slab. There should be no joints of any sort. Where weakness is suspected, reinforcing should be used. 3,000 per sq. inch concrete is recommended. A key or rods should be used to stabilize the foundation.

F. The shield 20 is vulnerable to punctures and should be protected at all times. Should there be puncture, it should be repaired immediately. Constructing foundations is a heavy job, so that the shield must be protected. Fold the excess shield over itself to allow as much walking space as possible. Build a bridge over the shield by leaning plywood on the footing edge.

G. With the shield protected, the foundation forms for the walls 23 may now be placed and the concrete poured.

H. After the removal of the forms, break off all steel rods. Remove any sharp object or cement over them. Remove the protecting plywood and round off the 4" shelf against the foundation, by applying concrete to form a fillet 49. Allow to dry overnight.

I. Now, taking the extra 4' of construction shield, pull and stretch it on the foundation walls, slapping and pulling it and removing all pocket wrinkles. With the reinforcing element 47, beginning on the very top of the foundation, go across the to bringing it down on the side overlapping the bottom shield by 2' and cut off. Do this all the way around the foundation, compressing it and bonding it as it is being done. The sill of the structure will be placed directly on the shield to hold it securely.

J. In treating foundation pipes, mark the exact size on the location that any pipe is to enter. Cut the exact size of the shield out, and then cut the hole through the foundation. Take a section of pipe and place it in the opening and cement it tightly around the pipe and allow to dry overnight. The following day, place the sleeve 46 on the pipe as described above.

K. In back filling, any earth can be re-used, but it is never advisable to use the foundation as a dumping ground for waste and rolling rocks. Heavy fill and large stones are a major cause of foundations cracks. Take great care in back-filling the foundation, lest the shield 20 be damaged.

L. Reinforcing is very often an important part of masonry work; in any case where there is extreme ground movement or heavy water pressure, reinforcing is vital. Many a concrete or gunite swimming pool has broken because of water pressure. Today it is good building practice in building a swimming pool to have a relief valve to cause the water pressure to enter the pool rather than lift and break it. Light gage wire has little strength and it is very hard to control. It's ends are like needles, and can quickly penetrate the shield. Reinforcing rods, are not to be set directly on the ground because of their weight. Once they are set in place and the concrete is being poured, it is too heavy a mass to lift. Rods are to be set on blocks at approximately 1 ½" to 2" over the bottom and it may be necessary to have a double layer. All rods must be securely tied together, so that they do not move. The amount of steel and size will depend on ground movement and mainly water pressure. Dry sandy areas seldom have any ground problems.

M. Ledge is not only expensive to remove, but under certain conditions, can cause masonry cracks. Where a structure is built partially on ledge and partially on soft ground, cracks can appear. While one portion underneath is unmovable, the other portion moves and eventually a crack will separate the two extremes. It would be desirable that either the entire structure be on ledge or else not on ledge at all. To avoid the situation, two steps can be taken. Lower the ledge below the ground level and cover with fine fill. Taking steel rods, place them across where the ground and the ledge meet. This will add great strength to the general area and should prevent cracking.

N. Chimneys, fireplaces, bulkheads are frequently attached to a foundation and are not a part of it. They are a constant source of water, radiation and problems. To be protected by the shield 20, these accessories must be a part of the footing and foundation.

O. In using the construction shield 20, it is more desirable for all pipes to go through the foundation wall 23, rather than the floor. If the possibility of extreme water pressure is present, going through the wall is absolutely vital. To run pipes from underneath the floor, they must be below the earth level prior to pouring the footing. At the point of entrance, they should be equipped with an elbow and come directly up through the footing into the structure. Pipes running fully or partly in the floor cause a construction weakness. If there is insufficient depth, a different basement plan should be made. In severe water areas, all piping should come through the side walls. Where pipes are coming through the basement floor, it is advisable to keep them as low as possible to the finished floor, thus making it easier in placing the construction shield. All incoming pipes must be equipped with the sleeves 46.

P. Sleeves are an accessory of the construction shield that fit on the pipe bonding it to the shield. If pipes are in the floor, they are to be dug down 1′ below the ground level and the pipe cleaned and the shield properly set in place by winding it around and thoroughly bonding it to the pipe. The top lip should be even with the top of the earth floor. Once the sleeve has been properly placed, the earth is to be replaced in the hole and compressed by pressing down with the feet. After the shield has been pulled across the entire earth surface, put in proper place over the impression of the protruding pipe the hole is to be tightly cut over the existing pipe. The shield is then to be pulled down tightly over the pipe and pressed down upon the existing sleeve cover which is now lying upon the ground snugly around the pipe. After the shield has been placed the exact location and size of the pipes should be determined and marked with a crayon. The shield is then cut and a hole is cut through the foundation allowing the pipe easy entrance. Excessively large holes should be avoided. A section of pipe should then be placed through the opening of the hole and re-cemented. The following day the pipe extending 10″ from the wall should be cleaned and the sleeve wrapped around the pipe 1¼ times tightly squeezing it around the pipe seeing that the lips of the sleeve are right to the foundation and they too are to be firmly pressed and squeezed into the existing shield causing them to be a unit.

Q. Unless drywells and cesspools are properly installed they can be the source of pollution and water backup. They must be away from the house and the piping sloped away from the house with proper traps and a ventilating system. Dry wells in basements with just a drain plate over them are the source of pollution and water. Straight pipes just going into some homemade drywell can and are the source of water and pollution.

R. Construction with the shield 20 must follow good building practices for the location. Where there is ground heaving due to frost, there must be a foundation (frost walls) which go below the frost depth. Few foundations which are built on hills are constructed properly. Constructions on a hillside where half the foundation is in the bank and the other half is on the top of the ground is only a half of foundation. Because a structure is made out of masonry or concrete does not necessarily make it a foundation. A foundation is a masonry or concrete substance that goes deep down into it and sits upon solid ground and is unaffected by the frost. In using the construction shield on these conditions, a foundation (a frost wall) must first be placed. Because of the use of the construction shield this will be a separate part of the foundation. The frost wall can consist of a poured concrete foundation or, in this case, a block wall is acceptable. Upon its completion the earth is to be replaced and compacted. Frost walls can also be lifted if they are improperly placed or constructed. It is to be located directly under the outside floor of the upper construction as would any concrete wall. And the upper floor or the upper foundation is not to be beyond this wall. If the upper structure is penetrating out beyond the wall into the frost level, it is of no avail. The walls are also to be as smooth as though they were to be viewed by people. If it is a concrete wall, forms are to be used. If the walls are not consistently even, the frost has pockets in which to lift the structure. An example would be a block wall where all the same size blocks were used until the top and then larger blocks were used in the top half; the frost would then go underneath the larger blocks and lift the structure. With the earth now replaced and compacted, the remainder of the procedures can go forward. The earth is to be prepared, any pipes are to be laid. It is to be compacted. The shield is to be laid in all directions overlapping by 4′. The concrete footing forms are then to be laid and are not to go beyond the frost wall.

S. The three major foundations consist of poured concrete, stone and field stone, and cement blocks. Concrete walls poured have great strength and have the most resistance against water. Stone or field stone foundations when properly laid have been known to exist for thousands of years. Pre-cast cement blocks may be convenient and cheap to work with, but certainly are not long lasting in comparison to concrete or stone. In sandy dry areas, cement blocks may be suitable. In areas where the ground constantly moves because of frost, blocks - source of problems. Any of these three means can be used with the construction shield. A block wall should be placed directly on the finished footing-floor as specified. A stone wall can follow the same procedure. In dry areas with no water pressure whatsoever, a stone wall can follow a cheaper procedure by preparing the ground, laying the construction shield as specified, and then placing the stone wall on the shield. Then, a 4″ floor is placed over the shield inside. All voids on the outside are then filled with cement. Upon drying, the shield is overlaid in the customary manner.

The operation and advantages of the above of the invention will now be readily understood in view of the above description. The present invention is a new concept in construction together with a specially-designed membrane in which the entire below ground structure in encased. Unlike conventional constructions, where the floor slab is placed first, in this concept the floor is placed after the shield has been laid even when retrofitting an older building. The shield is brought up and folded over the footings and bonded to the walls. The result is that the entire below-ground structure is encased by the structural shield. The purpose of the invention is to shield structures from the decaying affect emanating from the earth such as, moisture, water, chemicals, odors and gases such as radon.

The benefits are very clear. Moisture is a very expensive problem. Mildew tends to build up causing paint to peal and causing wood rotting, and plasted walls to crumble. Lolly columns, furnaces and other metal parts need replacement because of rust. Rugs filled with odor, loss of heat essence insulation becomes wet and ineffective. The structure becomes infested by insects. More importantly, the radon passes freely into the living area.

So far as water is concerned this causes devastation in the millions of dollars in terms of ruined furniture, rugs, furnaces and storage areas are turned into disaster areas. Homes have to be sold at reduced prices because of water, or cannot be sold at all. This is particularly true of radon infestation.

Drainage pipes when placed around the foundation very often fill with earth in just a few years, and sometimes in a years time they are rendered useless. The present invention shield eliminates the need for drainage pipes.

Some pumps are noisy and demand constant vigilance. There is a possibility of clogging, mechanical failure, power failure, water capacity failure, and when the house is sold the presence of a pump can mean a loss in the prices available.

Finally, since radon is considered by health officials as the No. 2 cause of lung cancer deaths, slightly behind cigarette smoking. Certainly, being able to minimize this threat is a worthy endeavor.

Also, toxins, pollutions, and odors emanating from the ground are becoming an ever-increasing reality. It is impossible to examine an empty lot and predict with any certainty that with a structure in it, it would not well become the victim of what remains in the earth. This is particularly true in areas where chemical manufacturing is taking place in past years or where mining has taken place and the residue of the mining constitutes the fill on the ground.

The present structural shield is a marriage between metal and polymers. While plastics or polymers will stop water, they do not have the density to stop radon gasses and other harmful chemical gasses that may be admitted from the earth. The present invention provides not only a strong damage-proof shield, but one that contains metal that will stop radon and other hazardous waste that plastic alone cannot stop. It should be pointed out that concrete is porous and, therefore, allows the passage of moisture and vapors. Not only is the moisture bad for the structure, but the vapors may be intolerable to human life.

It can be seen, then, that the present invention provides a security against the entry of radon into the living rooms of a structure whether the shield is provided at the time that the foundation is formed or after it is formed. In both cases, the security is present.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Shield for building foundation, comprising:
(a) a concrete slab having upper and lower horizontal surfaces,
(b) a rectangular configuration of concrete walls resting on and extending vertically from the upper surface of the slab, each wall having a substantial horizontal upper surface adopted to receive building sills,
(c) a sheet consisting of a lamination of metal sheet and high strength polymer, the sheet extending over one surface of the slab, extending over one surface of each wall, and extending over the upper end surfaces of each wall to provide a gas-proof enclosure around the foundation, which enclosure is open at the top, wherein the sheet lies over the lower surface of the slab, over the outer vertical surface of the walls, and extends inwardly over the upper end surfaces of the walls.

2. Shield for building foundation as recited in claim 1, wherein a reinforcing element overlies the sheet along the upper end of the walls an extends downwardly over, the sheet along the outer surfaces of the walls to below ground level.

* * * * *